US008024954B2

(12) United States Patent
Melgaard

(10) Patent No.: US 8,024,954 B2
(45) Date of Patent: Sep. 27, 2011

(54) METHOD FOR MAKING A COLD-WORKED ARTICLE

(75) Inventor: Kristian Melgaard, Skive (DK)

(73) Assignee: Alfa Laval Corporate AB, Lund (SE)

( * ) Notice: Subject to any disclaimer, the term of this patent is extended or adjusted under 35 U.S.C. 154(b) by 843 days.

(21) Appl. No.: 11/722,016

(22) PCT Filed: Dec. 15, 2005

(86) PCT No.: PCT/DK2005/000795

§ 371 (c)(1),
(2), (4) Date: Jan. 7, 2008

(87) PCT Pub. No.: WO2006/063595

PCT Pub. Date: Jun. 22, 2006

(65) Prior Publication Data

US 2008/0271512 A1 Nov. 6, 2008

(30) Foreign Application Priority Data

Dec. 16, 2004 (DK) ..... 2004 01946

(51) Int. Cl.
*B21D 11/02* (2006.01)
*B21D 22/00* (2006.01)
*B21D 31/02* (2006.01)

(52) U.S. Cl. ..... 72/370.27; 72/296; 72/348; 72/353.2

(58) Field of Classification Search ..... 72/296, 72/348, 350, 352, 353.2, 353.6, 354.2, 354.6, 72/361, 370.27, 356–358, 360; 29/890.12, 29/890.126, 890.13, 890.132
See application file for complete search history.

(56) References Cited

U.S. PATENT DOCUMENTS 691,454 A 1/1902 Dies
(Continued)

FOREIGN PATENT DOCUMENTS

DE 2 032 132 A 5/1971
(Continued)

OTHER PUBLICATIONS

International Search Report for International Application No. PCT/DK2005/000795.

*Primary Examiner* — Teresa Ekiert
(74) *Attorney, Agent, or Firm* — Roberts Mlotkowski Safran & Cole, P.C.; David S. Safran

(57) ABSTRACT

In a method for cold-working a piping component (10) with a pipe branch (16), particularly a valve housing of stainless steel, the pipe branch (16) is provided its length and final bore by forcing at least one ball or a drawing tool with partially spherical surface in direction from an inner cavity in the component and outwards.

The inventive feature of the method is that before the drawing of an opening, there is performed clamping of the component (10) in a matrix tool composed of several parts (2, 4, 6, 8), the parts of the matrix tool fitting closely to the greater part of the external surfaces of the component, so that surfaces at the parts of the component to be cold-worked are fixed during the drawing operation. Thereby, the drawing action will not distort the external or adjacent parts of the component or change the dimensions of the component, and control of the form and dimensions of the component is provided during the drawing action. Finishing treatment in the form machining is thus greatly reduced and material is saved by the method.

5 Claims, 11 Drawing Sheets

U.S. PATENT DOCUMENTS

| | | | | | |
|---|---|---|---|---|---|
| 1,911,653 | A | * | 5/1933 | Taylor | 29/890.148 |
| 2,762,326 | A | | 9/1956 | Burkhart | |
| 3,342,648 | A | * | 9/1967 | Zucker et al. | 72/368 |
| 3,611,552 | A | * | 10/1971 | Cushing et al. | 72/348 |
| 4,083,219 | A | | 4/1978 | Combes et al. | |
| 4,688,312 | A | * | 8/1987 | Sasao et al. | 29/890.13 |
| 5,715,721 | A | | 2/1998 | Anders et al. | |
| 6,044,683 | A | | 4/2000 | Shigemoto | |

FOREIGN PATENT DOCUMENTS

| | | | |
|---|---|---|---|
| EP | 1 166 925 | A2 | 1/2002 |
| GB | 1 400 986 | | 7/1975 |
| GB | 2 166 373 | A | 5/1986 |
| GB | 2 167 691 | A | 6/1986 |
| JP | 55-147421 | A | 11/1980 |
| JP | 1-266914 | A | 10/1989 |
| WO | 97/11799 | A1 | 4/1997 |

* cited by examiner

METHOD FOR MAKING A COLD-WORKED ARTICLE

TECHNICAL FIELD

The present invention concerns a method for making a cold-worked article, in particular a component for pipe systems, and where the component has at least one projecting pipe branch.

BACKGROUND OF THE INVENTION

In most process plants with piping in which fluids are transported, a number of valves are used so that the liquid flow can be controlled, stopped and/or conducted from one pipe system to another.

The valves include a valve housing in which valve body, valve seats etc. are mounted. The valve housing is typically made by a machining process as this is a well-known and tested manufacturing process. However, there are drawbacks in using the machining process as it e.g. requires application of large and complicated machines, e.g. CNC-machines, cutting or machining, starting with a piece of work and proceeding to the finished valve housing. Furthermore, there is a great waste of material in machining operations, as the cuttings are not recyclable and thus treated as waste material.

In the food industry, it is very important that fittings, e.g. pipe transitions, valves, pipe connections and similar used in the process plants, fulfill strict quality requirements. They are to be equipped with special internal even and cleaning-friendly surfaces, as edges, projections, holes and the like otherwise may constitute a possible contamination trap and thus impede good hygiene. This also applies to valve housings, which are to have smooth inner surfaces so that liquid residues cannot be accumulated and thereby constitute a trap for residues and impede cleaning of the pipe system.

The drawbacks in connection with machining processes may be avoided by using cold-working processes. Cold-working processes are advantageous in that they provide the finished article with smooth transitions without edges or rough faces that may trap fluid residues and which are also cleaning-friendly. Besides, cold-working may provide dimensionally accurate details, something which is not so easy with articles worked at high temperatures. Furthermore, cold-working is possible with the stainless steel alloys most often used in the food industry. Finally, the cold-working process does not leave much, if any, waste material.

Such cold-working methods for the valve housings and other components for pipe systems are known. A circular blank is formed into a pot with largely rotational/symmetrical shape, the pot is provided with a number of openings in its side and/or end faces, and at least one of the openings is drawn into a pipe branch by forcing a ball from an inner cavity in the component and outwards. In the process, material from the central parts of the components are drawn out into the wall of the pipe branch, the process thus distributing material from central regions to peripheral parts of the component.

An example of such a method is known from U.S. Pat. No. 4,083,219 where a drift forces the ball down through a cut opening opposite an already made pipe stub. The component in question is supported by a saddle-shaped female die. The internal parts of the die are rounded so that the material around the opening through which the bore is forced assumes an outer shape corresponding to the rounded details of the die. However, this method only provides a very short pipe stub around the opening, and further molding and extending of the pipe stub is difficult or impossible as the material around the deformation zone will be distorted, and since there is no control of the deformations, there is a risk of unacceptable dimensional changes, excessive thinning of the wall material, or even breaking of the material of the component.

ADVANTAGES OF THE INVENTION

One purpose of the invention is to relieve the drawbacks of the prior art and to provide a better control of the shaping of the material of a cold-worked component, in particular a valve housing.

Another purpose of the invention is to provide a method for cold-working a component for a pipe system, the component provided with elongated and dimensionally accurate pipe branches.

A further purpose of the invention is to provide a component for a pipe system where provision is made for sufficient material at the transition between adjacent and mutually perpendicular pipe branches or apertures in the component.

A method for making a cold-worked component according to the invention of the kind specified above is peculiar in that before the drawing of an opening in step c), there is performed clamping of the component in a matrix tool composed of several parts, the parts of the matrix tool fitting closely to the greater part of the external surfaces of the article, and fixing at least surfaces at the parts of the component to be cold-worked.

The method according to the invention may include other process steps known from the prior art, e.g. additional drawing and shaping actions by a ball or a drawing tool, one or more annealing processes, drilling or cutting actions etc. The component is clamped in a matrix tool composed of several parts, where such a matrix tool is composed of individual matrices and/or mandrels which are operated by hydraulic cylinders, or even mechanical devices, in a way know per se. The configuration and geometric shape of the matrix tool is adapted individually to the component concerned, it be a valve housing, a pipe fitting or other component in a pipe system. Also, the matrix tool has to be adapted to the shape and number of pipe branches or flanges surrounding apertures in the component. In any case, it is assumed that the component worked by the inventive method is largely hollow component with some kind of central cavity, where the at least one projecting branch extends out from this cavity.

When the matrix tool is closed around the component before the drawing action of the ball or the drawing tool, largely all external surfaces of the component are controlled in that internal faces of the matrix tool bear on the said external surfaces of the component, so that the outer shape and the material adjacent to the exterior of the component cannot be displaced except to a very minor degree during the drawing action. By suitable configuration and adaptation of the matrix tool, which will be possible for the skilled in the art, shaping of the material in the regions where deformation is taking place can be controlled. Thereby it is possible to mould even steel alloys to a much greater extent and in a more well-defined way than by the prior art methods. One substantial benefit is the attaining of a long pipe branch in the component.

For the making of a component with three or four outlets or apertures provided with pipe branches or flanges, it is preferred that the parts in the matrix tool include a bottom matrix and a top matrix that are disposed opposite each other in vertical direction, and two fixing mandrels that are laterally displaceable.

If the component is a valve housing with opposed pipe branches and with two other apertures provided perpendicular to the pipe branches it is preferred that the method includes the steps:

- the component is placed in a bottom matrix enclosing an external area of the component around one pipe branch pointing downwards during the drawing action;
- a top matrix adapted to the component is moved down until it fits to an external area of the component around the opposing upwards pointing pipe branch until the component is clamped between the bottom and top matrices;
- a first fixing mandrel is displaced into a first of the apertures before or simultaneously with a ball is passed through a second of apertures, where the ball comes to rest in a round opening at the inner side of the downwards pointing pipe branch;
- a second fixing mandrel is displaced into the second aperture, thus completing a clamping of the component between the top and bottom matrices and the mandrels;
- a drift is passed through a central hole in the top matrix and forces the ball through the downwards pointing pipe branch while widening and elongating the pipe branch.

If the component is a valve housing largely shaped as a T, and where the pipe branch is disposed opposite a wall in the housing, the method is preferred to include the steps:

- the component is placed in a bottom matrix enclosing an outer area of the component opposite the first pipe branch;
- a movable top matrix adapted to the component is moved downwards and fits to an outer area of the component around the first pipe branch until the component is clamped between the matrices;
- a drift is passed down through a central hole in the top matrix into the existing cavity in the component;
- an annular drawing tool with an external, partially spherical surface is mounted on the drift inside the cavity;
- then a first and a second fixing mandrel adapted to the component are moved into each their lateral aperture or pipe branch; and
- the drift with the drawing tool is drawn up through the first pipe branch while widening and elongating the pipe branch.

Some places in a component subjected to the method according to invention may be subjected to extreme deformation causing excessive thinning of the material thickness, particularly at the transition between mutually perpendicular pipe branches and/or flanged apertures. Is such a case, the method according to the invention includes embossing the component prior to the drawing process by a ball or a drawing tool. Such embossing may be effected while the component is clamped in a matrix tool and may be accomplished by a separate drift or punch provided with at least one lateral projection for engaging an inner face of the component and moving material at the inner side of the component towards the transition between the pipe branch and the flanged aperture or between pipe branches, respectively.

The material of the component moved by this embossing will then reinforce and make thicker the part of the component which is extended and thinned the most during the drawing action according to the invention.

THE DRAWING

The invention will now be explained more closely with reference to the drawing where:

EXAMPLE EMBODIMENTS OF THE INVENTION

Figure 1:
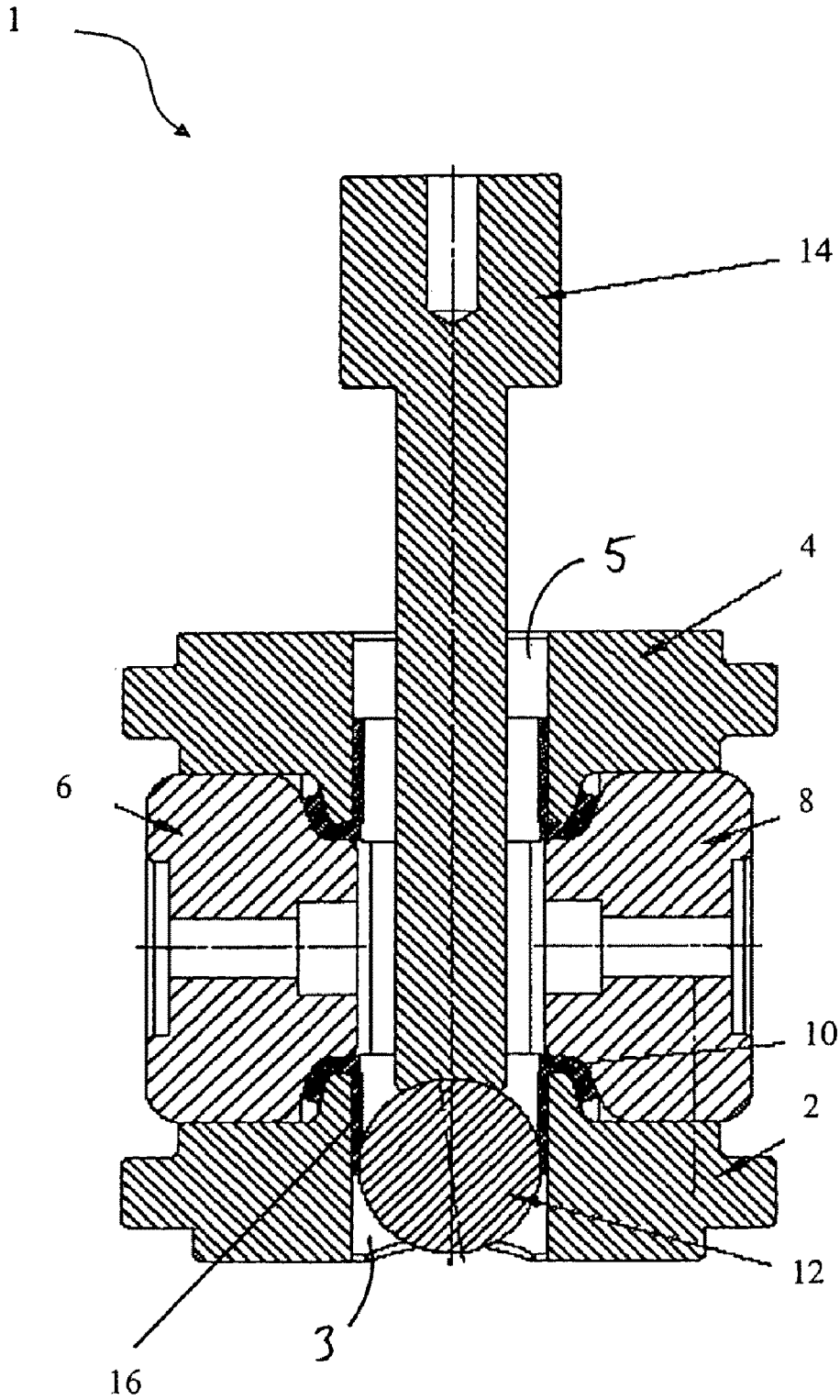
FIG. 1 shows a drawing of a pipe branch by means of a ball.

FIG. 1 shows a first embodiment of the method according to the invention, comprising drawing a pipe branch by means of a ball 12 in a component 10 with two mutually opposed pipe branches and two apertures with flanges provided in direction perpendicular to the pipe branches. On the figure appears a bottom matrix 2, a top matrix 4, a left mandrel 6 and a right mandrel 8, all the parts 2, 4, 6, 8 designed to closely fit to the component 10 and clamping the component 10 during the drawing of a pipe branch 16. The matrices 2, 4 are adapted to the mandrels 6, 8 by having lateral semicircular recesses that together form stepped circular recesses for receiving the mandrels 6, 8. The bottom matrix 2 has a central hole 3 adapted to receive and fit the exterior of the a pipe branch of a component to be formed, and the top matrix 4 has central hole 5 adapted to receive the exterior of an opposing pipe branch, as shown. The component 10 is intended as a valve housing to which is referred in the following text. The inventive method may be applied to other fittings, e.g. filter housings.

Initially, the valve housing 10 is placed in the bottom matrix 2, after which the movable top matrix 4 is moved downwards and closes around the top of the valve housing 10. The mandrel 6 is inserted into the left aperture from the left side, and the ball 12 is put into or runs into the valve housing 10 through the aperture at the right side, followed by the mandrel 8 being inserted from the right side, eventually fixing the housing 10. The housing 10 is now totally clamped from all sides so that the housing 10 does not change its shape during the working. Then a drift 14 is moved down through the hole 5 in top matrix 4 by a not shown hydraulic cylinder, forcing the ball 12 out through the hole surrounded by the pipe branch 16. By this process, the wall of the pipe branch 16 is internally widened and elongated.

Usually several balls 12 with increasing diameter are used in succession for the drawing process, the drift 14 performing a drawing action each time. The balls 12 may be supplied and placed manually, but in another embodiment a ball may be repositioned after falling down through the central hole in the bottom matrix 2 and be caught by a conveying arrangement provided under the level of the matrix 2, see the example described below in connection with FIGS. 7-9. The ball 12 is then moved upwards along a ramp to a not shown elevating device. The elevating device then lifts the balls one by one up upon a slide 510 as shown on FIGS. 8 and 9. The balls are stopped by a pneumatic cylinder at the end of the slide in connection with a ball magazine 508 as seen on FIGS. 8 and 9. When drawing a new pipe branch, the pneumatic cylinder allows the balls 12 to enter one by one, and the drawing cycle may thus run automatically.

The drawing action will now be performed repeatedly with balls 12 with gradually increasing diameter until the deformations in the structure of the material of the component 10 are so great that a intermediate annealing is necessary for normalizing the structure of the material.

The repeated drawing actions reduce the material thickness of the valve housing 10 in the pipe branch 16 as well as in the central parts of the housing 10. The length of the drawn pipe branch 16 will be determined by requirements from the customer and by physical limitations of the material.

Figure 2:
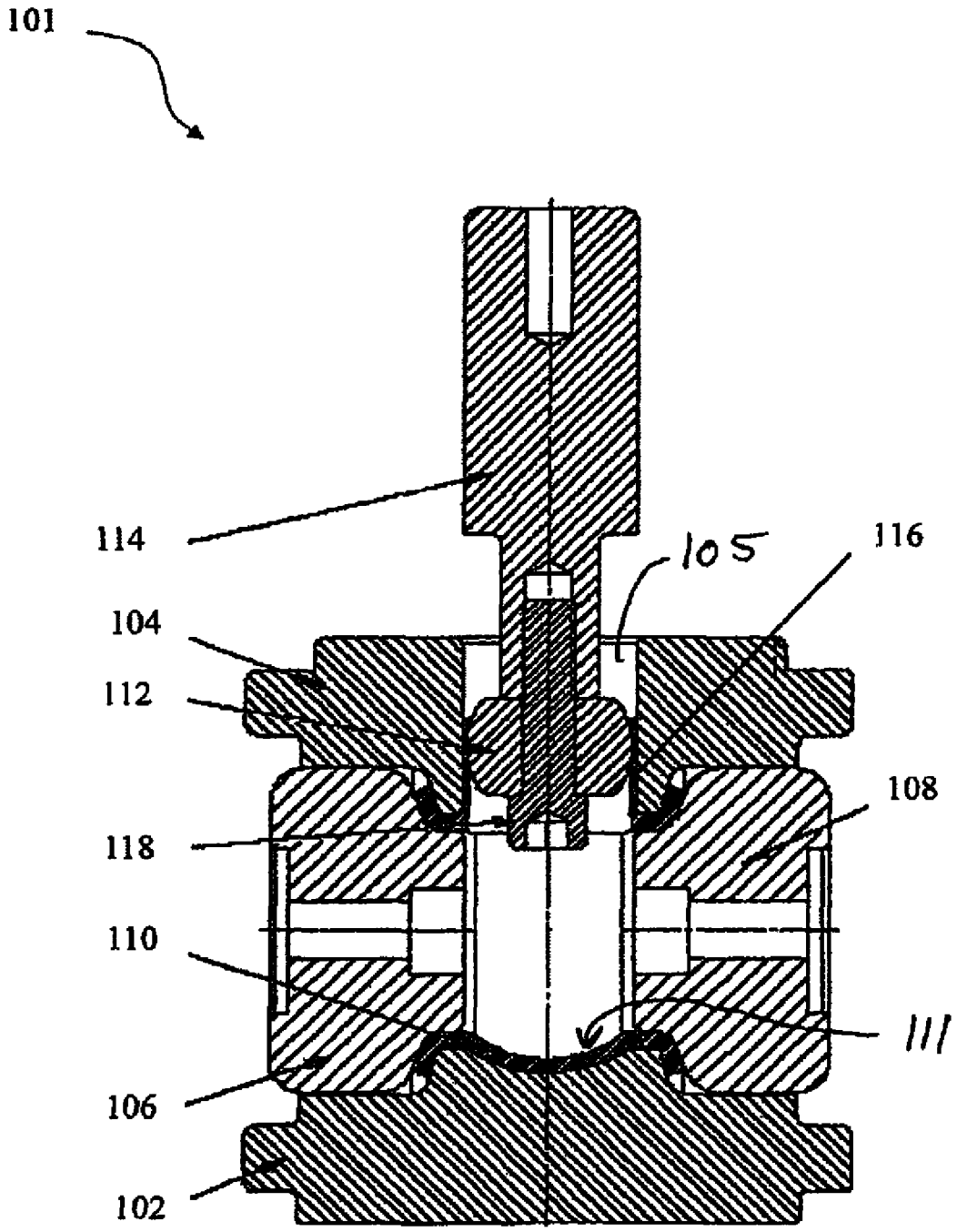
FIG. 2 shows a drawing of a single pipe branch by means of a special drift.

FIG. 2 shows a second embodiment of the method according to the invention, comprising drawing of a pipe branch 116 in a valve housing 110, which is largely T-shaped, and where the pipe branch 116 is disposed opposite a bottom or wall 111 of the housing 110. The matrix tool used in this connection comprises a bottom matrix 102, a top matrix 104, a left mandrel 106 and a right mandrel 108 for fixing and clamping the valve housing 110. The top matrix is provided with a central hole 105 that may receive and fit the exterior of a pipe branch 116 to be drawn by the inventive method. The drift 114 can be lowered into the interior of the housing 110 through the central hole 105 in the matrix 104 so that an annular drawing tool 112 may be mounted by means of a screw bolt 118 to the free end of the drift 114. The annular drawing tool 112 comprises partly spherical, or at least rounded, surfaces at the periphery for engaging the inner sides of the pipe branch 116 during the drawing action. The present embodiment of the inventive method provides that after placing the housing 110 on the bottom matrix 102, the drift 114 is moved down, the drawing tool 112 is mounted, after which the top matrix 104 is moved down for engaging the top part of the housing 110, and finally the mandrels 106 and 108 are moved in from left and right, respectively, thus enclosing the housing 110 completely. Then the drift 114 is drawn upwards, as seen in FIG. 2, thus displacing the material in the pipe branch 116 by widening and elongating the bore of the pipe branch 116 during the drawing action.

This drawing action is repeated several times as a sequence with a number of drawing tools 112 having increasing diameters in succession. The sequence is continued until the desired elongation and shaping of the pipe branch 116 has been attained or until the deformations in the structure of the materials have become so large that an intermediate annealing is required for normalizing the structure.

The limitations for shaping the pipe branch 116 are the same as described above in connection with the embodiment associated with FIG. 1.

Figure 3:
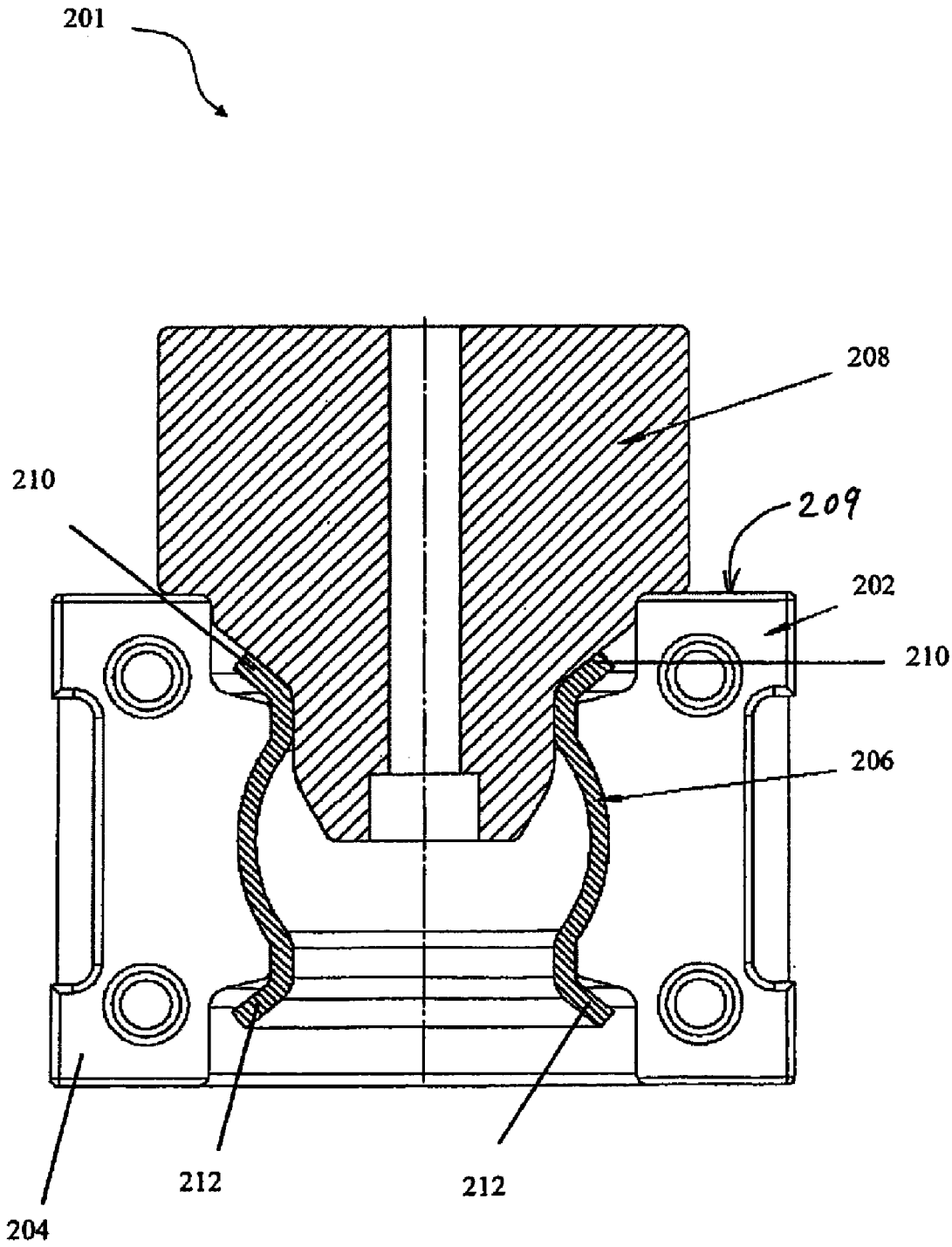
FIGS. 3 and 4 show two stages in forming flanges on a valve housing.
Figure 4:
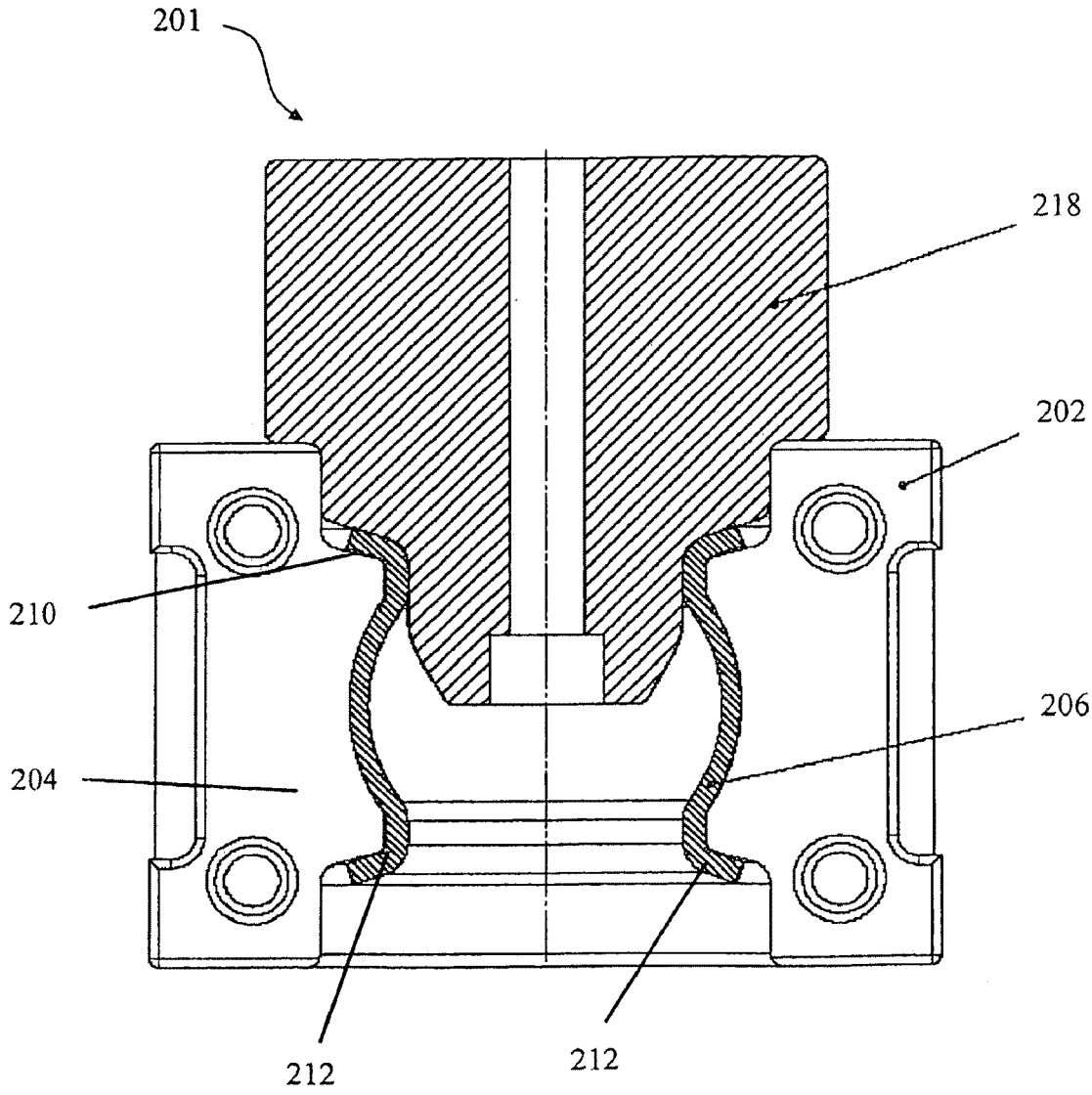

FIGS. 3 and 4 show bending and shaping of a flange 210 on a valve housing 206. The valve housing 206 is partly dome-shaped and is placed in a tool comprising matrices 202 and 204 adapted for the particular housing 206. The matrices are brought together by a not shown hydraulic cylinder. Then a punch 208 is brought down until it is stopped by striking a top side 209 of the matrices 202 and 204. Thereby, the flanges 210,212 are bent and preformed. The final shaping of a flange 210 is then performed by using a different punch 218 with a slightly different shape in a succeeding process step as seen on FIG. 4. Here, the flange 210 is now further bent and shaped and is completely squeezed between the punch 218 and the matrices 202, 204. By this action it is possible to displace material to other areas of the housing 206.

Figure 5:
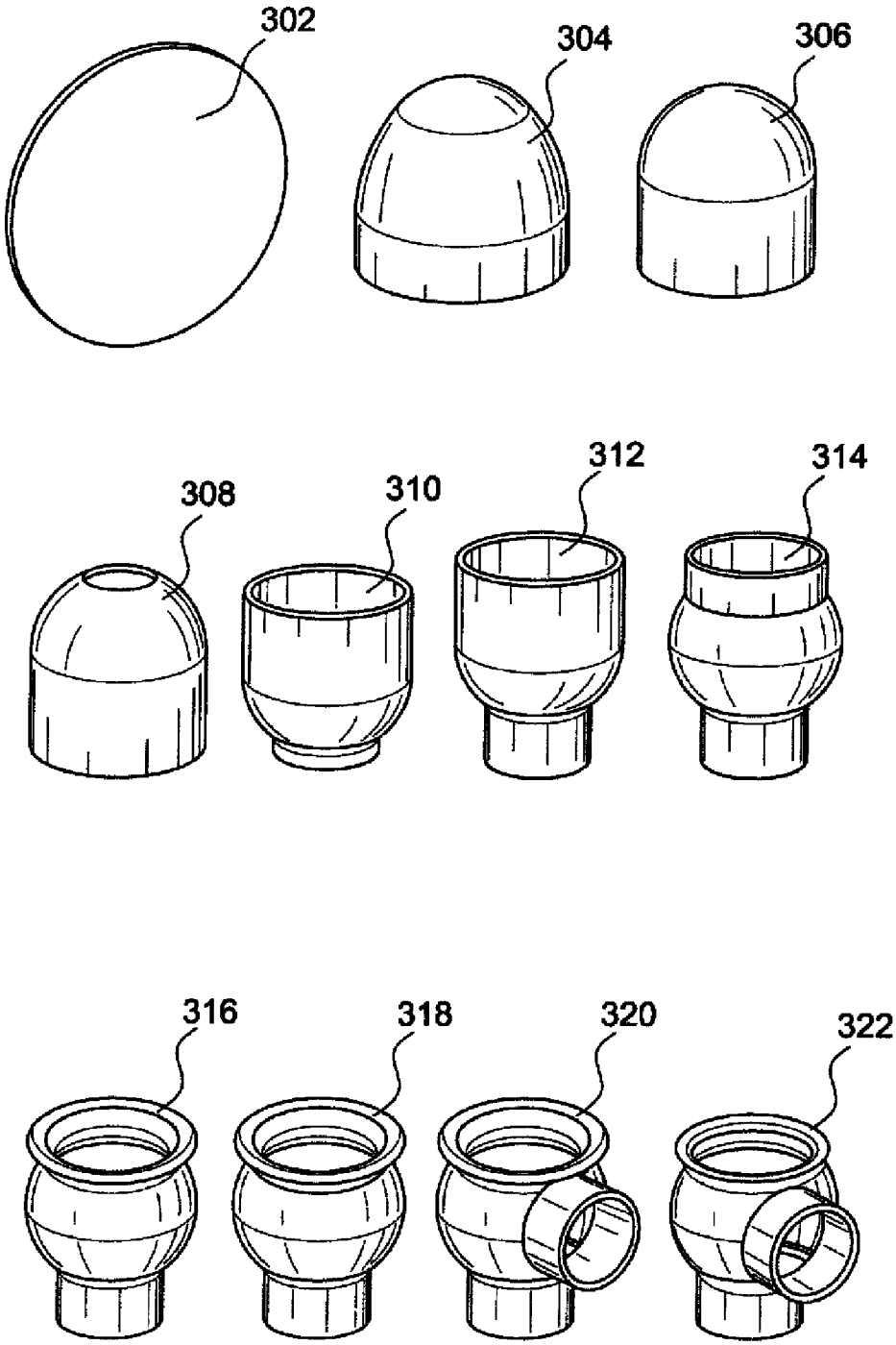
FIG. 5 shows manufacturing of a L-shaped housing from a circular blank.

FIG. 5 shows application of the inventive method in the making of a valve housing with three apertures from a circular blank, where two of the apertures provided with pipe branches extending perpendicularly to each other, the process including the following steps:

I) The valve housing, in this case a L-shaped housing, starts from a laser-cut circular blank 302;

II) then a first drawing action by a method known by the skilled in the art is performed whereby a pot 304 is formed;

III) followed by second drawing action, e.g. as described in connection with FIG. 10 below, where the pot is provided with a spherical shape at one end 306;

IV) followed by annealing of the work piece in order to normalize the structure of the material (not shown);

V) a hole 308 is drilled in a CNC lathe before drawing;

VI) the edge around the hole made in the previous step is pressed into a pipe stub 310;

VII) the pipe stub 310 is drawn with a ball under application of the method according to the invention, in principle as shown on FIG. 1 with associated description, thus forming a pipe branch 312;

VIII) the valve housing is provided with dome-shape 314, e.g. as described in connection with FIG. 11 below;

IX) followed by annealing of the work piece 314 in order to normalize the structure of the material so that a further drawing action is possible;

X) at the aperture opposite the formed pipe branch, a flange 316 is pressed, e.g. by the method shown in FIGS. 4 and 5;

XI) a laterally directed hole 318 is drilled with a CNC drilling machine;

XII) a pipe branch 320 extending perpendicularly to the branch 312 is drawn with balls by the method according to the invention, in principle as shown on FIG. 2 with associated description;

XIII) valve housing 322 is finished in a CNC lathe, followed by de-burring and grinding internally and externally in a way known per se.

The number of annealings may be different compared with the shown example as this is depending on the specific material and the extent of the deformation of material in the drawing actions. The shown process is an example for making a valve housing of stainless steel, illustrating how a complicated component 322 can be made without joints from a circular blank 302 by means of applying the present inventive method.

Figure 6:
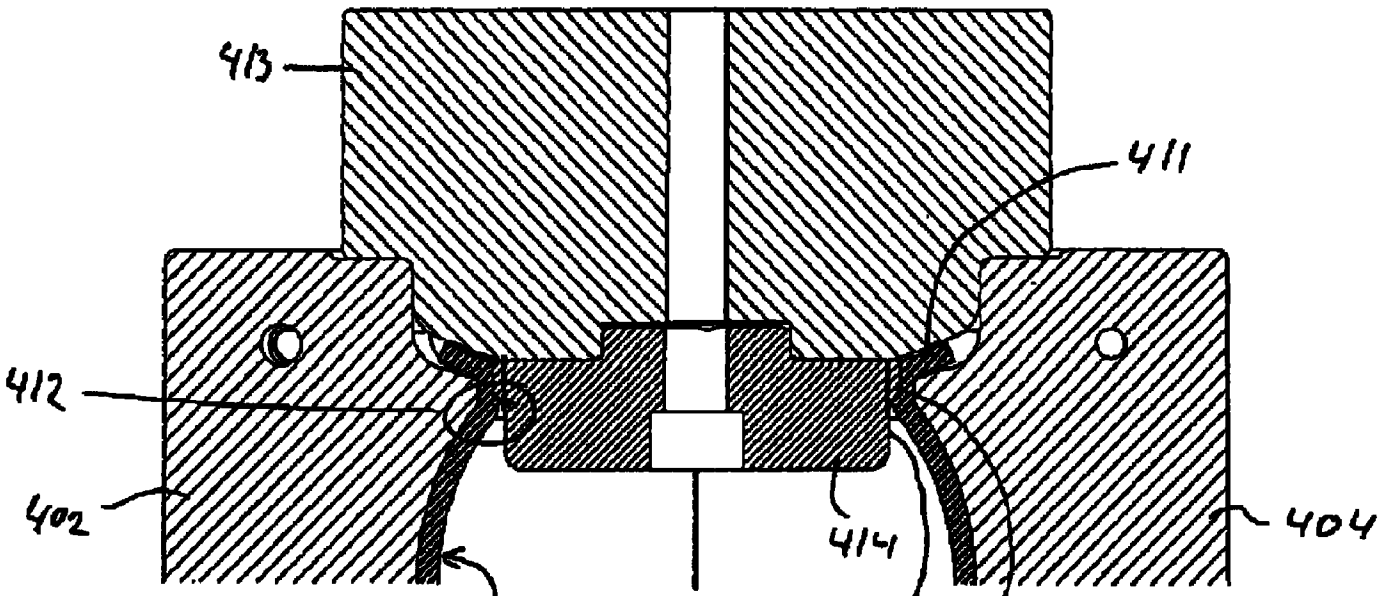
FIGS. 6 and 6A shows providing an embossing at an inner side of a housing.

FIG. 6 shows an additional step in making a component according to the inventive method, making an embossing at a transition between two mutually perpendicular pipe branch or a pipe branch and a flanged aperture. The component 410 may be such an intermediate product appearing between steps X) and XI) as described above in connection with FIG. 5.

Figure 6A:
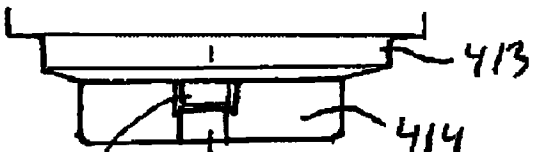

The sectional view of FIG. 6 shows the component 410 clamped between two parts 402, 404 of a matrix tool surrounding the external faces of the component 410 and supporting an annular flange 411 around an aperture. Only the top part of the component 410 and the tool parts 402, 404 are shown. The area 412 is a transition area of the component 410 which will be subjected to thinning during subsequent drawing of a lateral pipe branch perpendicularly to the existing flanged aperture. Therefore, an embossing is provided by means of a two-part drift 413, 414. The lower part 414 of the drift is cylindrical for fitting the bore of the flanged aperture except at two opposite points shown in the sectional view. FIG. 6A shows in a reduced scale a side view of the drift 413, 414 by itself. A lateral projection in the shape of a step 415 is provided at diametrically opposed positions on the part 414, which also has a tangential cut-out 416 below the step 415.

When the drift moves down upon the flange 411, the steps 415 engage a limited part at the inner side of the aperture and forces material downwards, thus thickening the wall material of the component 410 at the transition area 412 where subsequent thinning will take place later. The cut-out 416 allows for inward expansion of the wall material during the embossing action.

Figure 7:
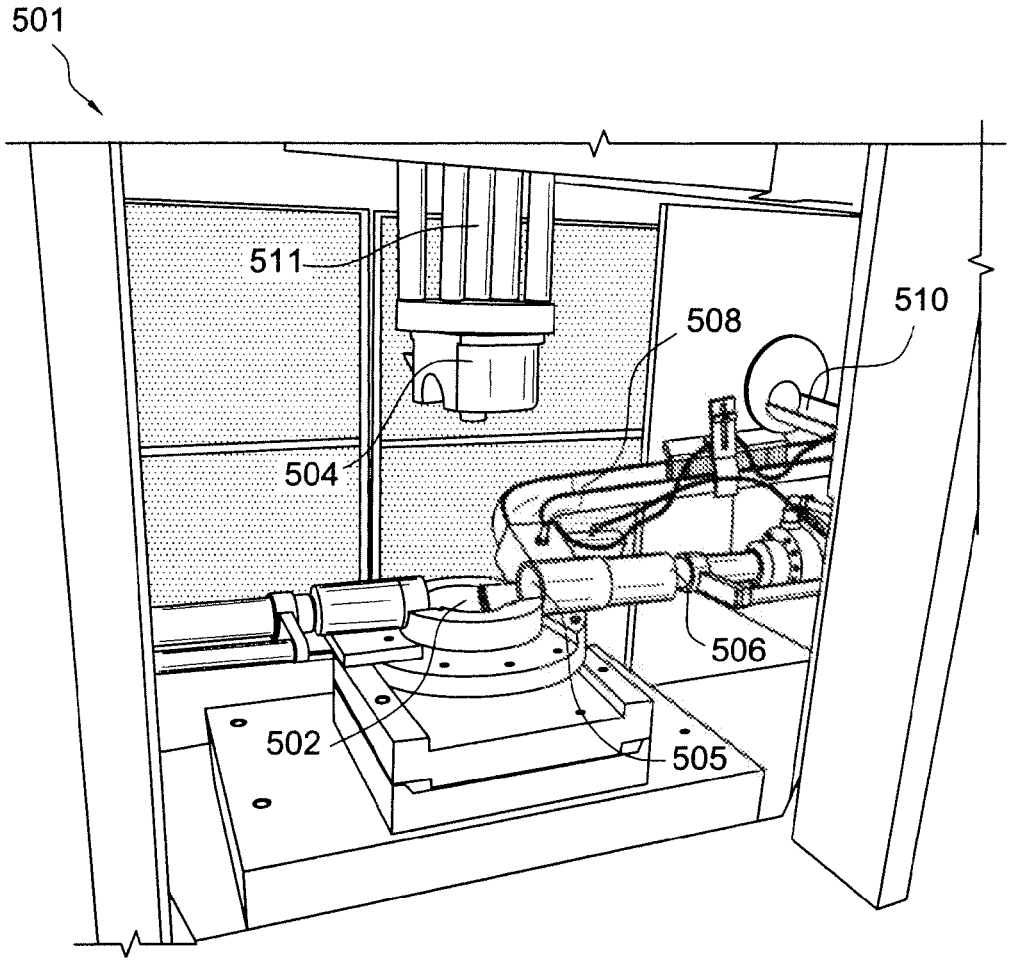
FIG. 7 shows a photo of an apparatus for making a valve housing.

FIG. 7 shows a view of an apparatus 501 for making a valve housing, the apparatus comprising a bottom matrix 502 and a movable top matrix 504 which may be actuated by a number of hydraulic cylinders 511. The bottom and top matrices 502, 504 are adapted to fit around the housing to be worked. The bottom matrix 502 is provided with a ball supply 505 so that a ball (not shown) from a ball magazine 508 can be inserted into the component via the ball supply 505 in the bottom matrix 502. The drift for pressing the ball (not shown) is connected with the hydraulic cylinder 506. The apparatus 501 is provided with a ball return system 510 which provides for bringing the balls (not shown) back to the magazine 508 after being forced out of the component.

Figure 8:
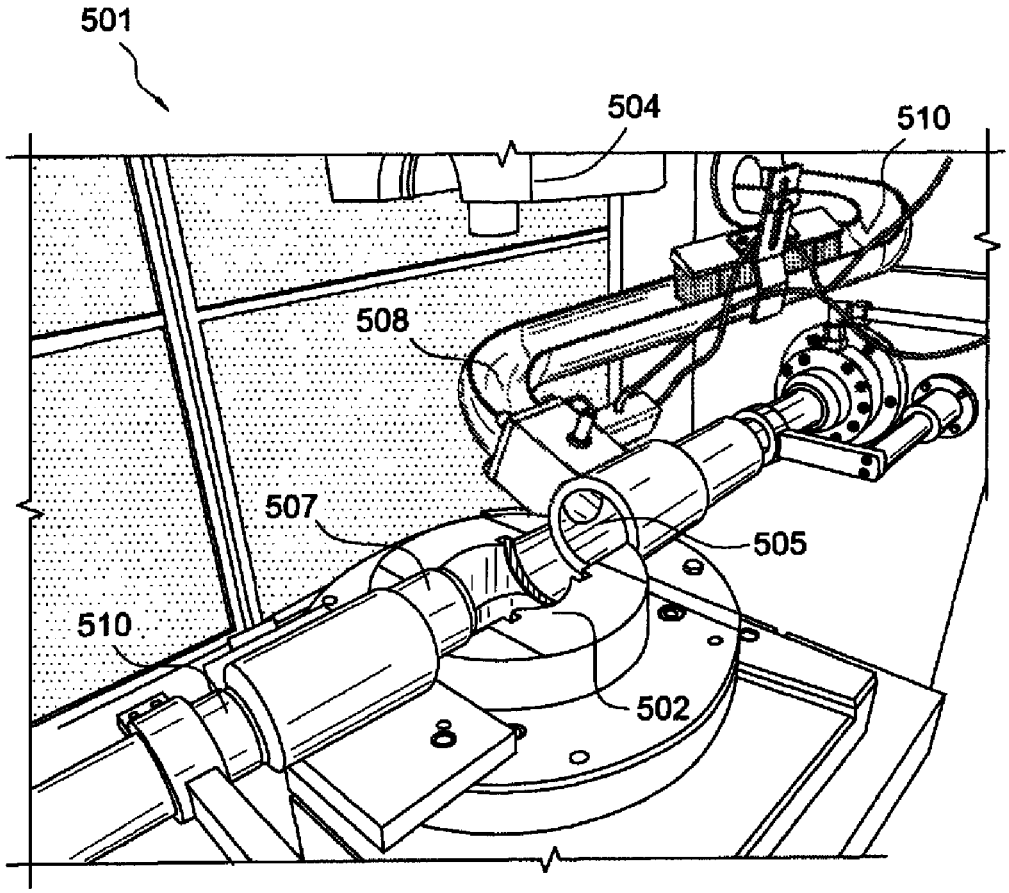
FIG. 8 shows the apparatus of FIG. 7 as seen from another angle.

FIG. 8 shows a close-up view of the same apparatus 501 depicted in FIG. 7, but from a slightly different angle. The bottom matrix 502 is connected with the ball magazine 508 via a supply 505. The bottom matrix 502 is furthermore provided with an outlet 507 connected with a ball return system of pipes and/or channels. The used ball (not shown) will hereby be moved back to the ball magazine 508. The ball return system 510 of course includes some mechanical means for bringing the balls back to the ball magazine; these means are however not shown on the Figure.

Figure 9:
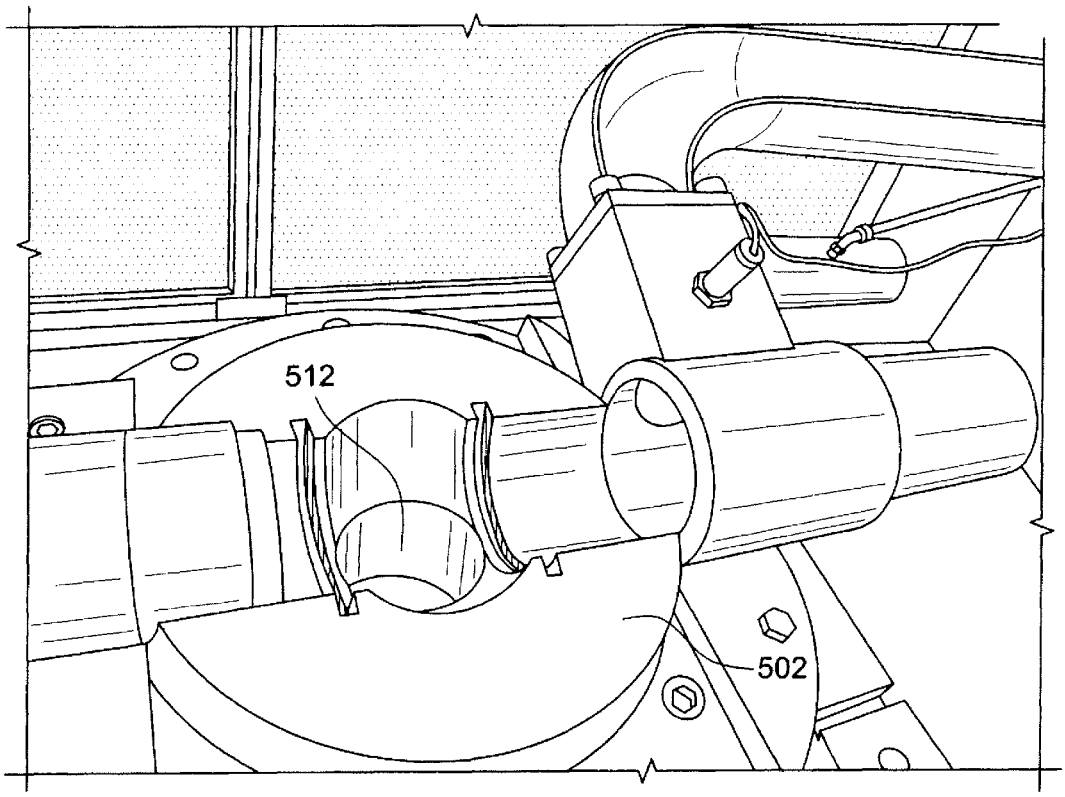
FIG. 9 shows a close-up photo of the bottom matrix of FIG. 7.

FIG. 9 shows a close-up view of the bottom matrix 502 where the ball outlet 512 appears at the bottom in the bottom matrix 502.

Figure 10:
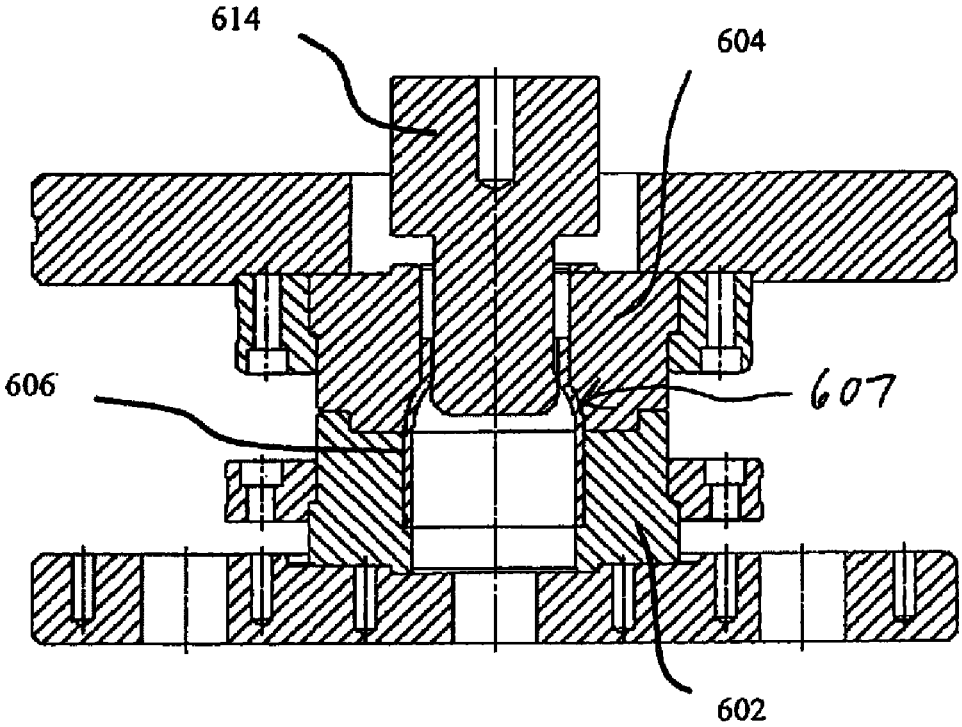
FIG. 10 shows dome-shaping of a first end of a cylindrical length of pipe.

FIG. 10 shows providing a dome-shape at a first end of a cylindrical work piece 606. The cylindrical pipe length 606 is inserted in a first matrix 602. The second matrix 604 mounted on a punch 614 is moved down, actuated by a hydraulic main cylinder of the press (not shown). The matrices 602,604 are moved together until they are in mechanical contact, whereby the doming in one end 607 of the cylinder piece 606 is effected. The punch 614 returns and calibrates the cylindrical edge, whereupon the matrix 604 opens and the cylindrical piece 606 is taken out.

Figure 11:
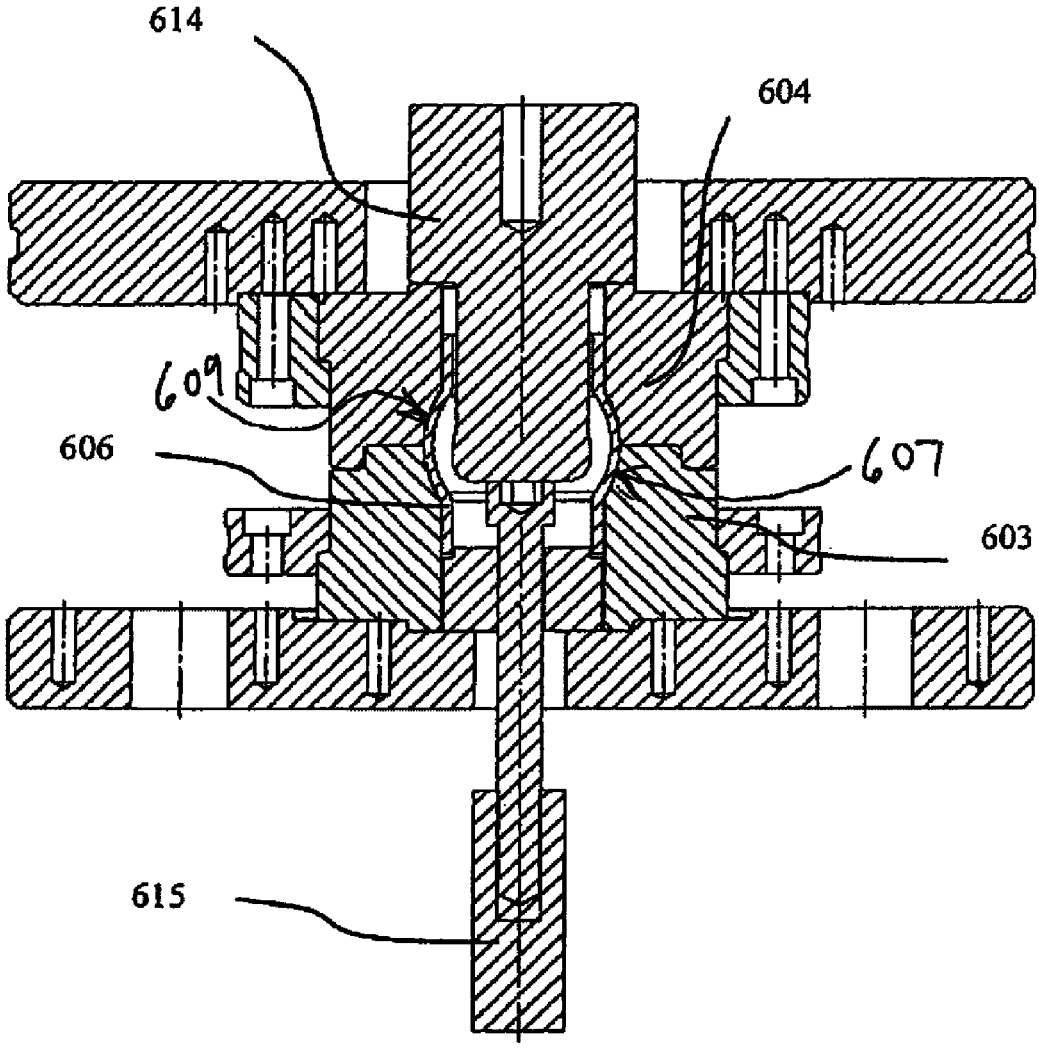
FIG. 11 shows dome-shaping of a second end of the pipe in FIG. 10.

On FIG. 11 appear providing a dome-shape at a second end 609 of the cylindrical piece 606 which has one end already shaped with a dome. This step is a step subsequent to the step shown on FIG. 10. The cylindrical piece 606 is inserted in matrix 603 with the already domed end 607 first. The second matrix 604 provided on the main piston (not shown) moves down together with the punch 614. The matrices 603, 604 move together until they are abutting so that the second end 609 of the piece 606 is domed. The punch 614 on the triple cylinder then returns and calibrates the cylinder edge of the cylindrical piece 606, whereupon the matrix 614 opens, and the work piece 606 is taken out by ejecting the piece 606 with a rod 615.

The invention claimed is:

1. A method for making a cold-worked component for a pipe system with at least one projecting pipe branch, including the following process steps:

a) cold forming a circular blank into a pot-shaped component with largely rotational-symmetrical shape;

b) providing the pot-shaped component with a number of openings in its side and/or end faces;

c) drawing at least one of the openings into a pipe branch by forcing at least one ball or a drawing tool with partially spherical surface in a direction outwards from an inner cavity in the pot-shaped component;

wherein, before the drawing of an opening in step c), clamping of the component in a matrix tool composed of several parts including a top matrix, a bottom matrix, a first fixing mandrel and a second fixing mandrel is performed, the parts of the matrix tool being closely fit to the greater part of the external surfaces of the component to be cold-worked.

2. Method according to claim 1, wherein the component to be produced is a valve housing with two mutually aligned and opposed pipe branches and with two mutually opposed apertures that are cold worked and which are directed perpendicularly to the pipe branches, and wherein said at least one ball or a drawing tool is a ball, the method including the steps of:

placing the cold-formed component the bottom matrix enclosing an external area of the component around one pipe branch pointing downwards during the drawing action;

moving the top matrix adapted to the component down until it fits to an external area of the cold- formed component around the opposing upwards pointing pipe branch until the component is clamped between the bottom and top matrices;

displacing the first fixing mandrel into a first of the apertures before or simultaneously with the ball being passed through a second of apertures, where the ball comes to rest in a round opening at the inner side of the downwards pointing pipe branch;

displacing the second fixing mandrel into the second aperture, thus completing a clamping of the component between the top and bottom matrices and the mandrels;

passing a drift through a central hole in the top matrix and forcing the ball through the downwards pointing pipe branch while widening and elongating the pipe branch.

3. Method according to claim 1, wherein the component to be produced is a valve housing provided with a first pipe branch and two mutually aligned and opposed lateral apertures and/or pipe branches directed perpendicularly to the first pipe branch, so that the first pipe branch is disposed opposite a closed wall in the housing, and wherein said at least one ball or a drawing tool is an annular drawing tool, the method including the steps of:

placing the cold-worked component in a bottom matrix enclosing an outer area of the cold-worked component opposite the first pipe branch;

moving a movable top matrix adapted to the component downwards and fits to an outer area of the cold-worked component around the first pipe branch until the cold-worked component is clamped between the matrices;

passing a drift down through a central hole in the top matrix into the existing cavity in the component;

mounting the annular drawing tool with an external, partially spherical surface on the drift inside the cavity;

then, moving a first and a second fixing mandrel adapted to the component into each their lateral aperture or pipe branch; and drawing the drift with the drawing tool up through the first pipe branch while widening and elongating the pipe branch.

4. Method according to claim 1, wherein the method includes embossing the cold formed component prior to process step c), internally in a limited area at a transition area of the cold formed component which will be subjected to thinning during subsequent drawing of mutually perpendicular pipe branches and/or flanged apertures, while the cold formed component is clamped in the matrix tool, the embossing accomplished by a rotational-symmetric drift provided with at least one lateral projection for engaging an inner face of the cold formed component at the transition area and moving material at the inner side of the cold formed component towards the transition area.

5. A method for making a cold-worked component for a pipe system with at least one projecting pipe branch, including the following process steps:

a) cold working of a circular blank into a pot-shaped component with largely rotational-symmetrical shape followed by annealing to normalize the structure of the worked blank;

b) the pot-shaped component is then provided with a number of openings in its side and/or end faces;

c) cold working of at least one of the openings so as to draw a pipe branch by forcing at least one ball or a drawing tool with partially spherical surface in an outward direction from an inner cavity in the pot-shaped component;

wherein, before the drawing of an opening in step c), there is performed clamping of the pot-shaped component in a matrix tool composed of several parts, the parts of the matrix tool fitting closely to the greater part of the external surfaces of the component, and fixing at least surfaces at the parts of the pot-shaped component to be cold-worked wherein the parts in the matrix tool include a bottom matrix and a top matrix that are disposed opposite each other in a vertical direction, and two fixing mandrels that are laterally displaceable.

* * * * *